US005890032A

United States Patent [19]

Aslam et al.

[11] Patent Number: 5,890,032

[45] Date of Patent: Mar. 30, 1999

[54] BELT FUSING ACCESSORY WITH SELECTABLE FUSED IMAGE GLOSS

[75] Inventors: Muhammed Aslam, Rochester; Arun Chowdry; William J. Staudenmayer, both of Pittsford, all of N.Y.

[73] Assignee: Eastman Kodak Company, Rochester, N.Y.

[21] Appl. No.: 992,057

[22] Filed: Dec. 17, 1997

[51] Int. Cl.[6] ..... G03G 15/20

[52] U.S. Cl. ..... 399/69; 399/329; 399/341

[58] Field of Search ..... 399/67, 69, 92, 399/165, 320, 328, 329, 341; 430/99, 124

[56] References Cited

U.S. PATENT DOCUMENTS

| | | | |
|---|---|---|---|
| 3,948,215 | 4/1976 | Namiki | 118/60 |
| 5,085,962 | 2/1992 | Aslam et al. | 430/99 |
| 5,089,363 | 2/1992 | Rimai et al. | 430/45 |
| 5,132,198 | 7/1992 | Tamary | 430/124 |
| 5,164,782 | 11/1992 | Nagayama et al. | 399/320 |
| 5,249,949 | 10/1993 | Aslam et al. | 399/328 X |
| 5,250,998 | 10/1993 | Ueda et al. | 399/329 |
| 5,256,507 | 10/1993 | Aslam et al. | 430/42 |
| 5,339,146 | 8/1994 | Aslam et al. | 399/342 |
| 5,392,104 | 2/1995 | Johnson | 399/301 |
| 5,666,592 | 9/1997 | Aslam et al. | 399/67 |
| 5,678,133 | 10/1997 | Siegel | 399/67 |
| 5,724,628 | 3/1998 | Sano | 399/69 X |

*Primary Examiner*—Arthur T. Grimley
*Assistant Examiner*—Sophia S. Chen
*Attorney, Agent, or Firm*—Lawrence P. Kessler

[57] ABSTRACT

A belt fusing accessory, for a reproduction apparatus, the belt fusing accessory providing selectable image gloss. The belt fusing accessory, as disclosed, includes a heated fuser roller and a pressure roller in nip relation with the fuser roller. A steering roller is located downstream of the nip between the fuser roller and the pressure roller. A fusing belt is entrained about the fuser roller and the steering roller. Heat to the fuser roller is controlled dependent upon the desired gloss condition for the colorant image on the receiver member.

7 Claims, 2 Drawing Sheets

BELT FUSING ACCESSORY WITH SELECTABLE FUSED IMAGE GLOSS

CROSS REFERENCE TO RELATED APPLICATIONS

U.S. patent application Ser. No. 08/992,872, filed Dec. 17, 1997, entitled "REPRODUCTION APPARATUS PROVIDING SELECTABLE IMAGE QUALITY AND GLOSS" in the name of Muhammed Aslam et al.

U.S. patent application Ser. No. 08/992,643, filed Dec. 17, 1997, entitled "BELT FUSER APPARATUS FOR PREVENTING LINE ART TYPE MARKING PARTICLE OFFSET" in the name of Muhammed Aslam et al.

U.S. patent application Ser. No. 08/992,058, filed Dec. 17, 1997, entitled "APPLICATION OF CLEAR TONER DEVELOPED NEGATIVE TO THE IMAGE IN AN ELECTROPHOTOGRAPHIC PROCESS TO ELIMINATE IMAGE RELIEF AND DIFFERENTIAL GLOSS ARTIFACTS" in the name of William J. Staudenmayer et al.

U.S. patent application Ser. No. 08/992,746, filed Dec. 17, 1997, entitled "APPLICATION OF CLEAR MARKING PARTICLES TO IMAGES WHERE THE MARKING PARTICLE COVERAGE IS UNIFORMLY DECREASED TOWARDS THE EDGES OF THE RECEIVER MEMBER" in the name of Muhammed Aslam et al.

U.S. patent application Ser. No. 08/992,060, filed Dec. 17, 1997, entitled "COOLING AND REUSING THE HEAT TO PREHEAT THE FUSING WEB IN A BELT FUSER" in the name of Muhammed Aslam et al.

U.S. patent application Ser. No. 08/992,056, filed Dec. 17, 1997 entitled "MECHANISM FOR TRACKING THE BELT OF A BELT FUSER" in the name of Muhammed Aslam et al.

U.S. patent application Ser. No. 08/992,059, filed Dec. 17, 1997, entitled "A COLLAPSIBLE CUSTOMER REPLACEABLE BELT FUSER ASSEMBLY DESIGNED FOR ACCESSIBILITY, SERVICEABILITY, AND FUSING BELT REPLACEMENT" in the name of Muhammed Aslam et al.

U.S. patent application Ser. No. 08/992,745, filed Dec. 17, 1997, entitled "APPARATUS FOR PACKAGING AND INSTALLATION OF A FUSING BELT" in the name of Muhammed Aslam et al.

FIELD OF THE INVENTION

This invention is directed in general to a fusing apparatus for a reproduction apparatus, and more particularly to a belt fusing accessory for a reproduction apparatus, such belt fusing accessory capable of providing selective gloss to colorant images formed on a receiver member, by the reproduction apparatus, upon fusing.

BACKGROUND OF THE INVENTION

Typical commercial reproduction apparatus include electrostatographic process copier/duplicators or printers, inkjet printers, and thermal printers. With such reproduction apparatus, a colorant such as pigmented marking particles, ink, or dye material (hereinafter referred to commonly as marking particles) are utilized to develop an image, of information to be reproduced, on a support member for transfer to a receiver member, or directly onto a receiver member. The receiver member bearing the marking particle image is transported through a fuser device where the image is fixed (fused) to the receiver member, for example, by heat and pressure to form a permanent reproduction thereon. While the fuser device is typically integral with the reproduction apparatus, it may also be an independent piece of equipment, generally referred to as an off line fuser. Off line fusers, being a device devoted to a single task, have the ability to have their operating parameters optimized to perform the fusing function.

Certain reproduction apparatus have been designed to produce multi-color copies. In such reproduction apparatus, multiple color separation images are respectfully developed with complimentary colored marking particles, in superposition on a receiver member. It has been found that fixing of multi-color marking particle images to a receiver member requires substantially different operating parameters than fixing standard black marking particle images to a receiver member. Moreover, the respective operating parameters may in fact be in contradistinction. That is, multi-color images require a high degree of glossiness for a full, rich depth of color reproduction; on the other hand, since glossiness for black marking particle images may significantly impair legibility, a matte finish is preferred.

It is known that the glossiness of a marking particle image is, at least in part, dependent upon the marking particle melting characteristics in the fixing process. In general, the fixing apparatus serves to soften or at least partially melt the marking particles, enabling the marking particles to permeate into the fibers of the receiver member so that the marking particles are fixed to the receiver member to give a glossy image reproduction. For example, the fixing apparatus may include a heated roller which contacts the marking particles and the receiver member. With multi-color marking particle images, the multiple color marking particle images are respectively melted and fixed by the heated roller. If the color marking particle images are not sufficiently melted, light scattering cavities may occur in the copy which degrades the color reproduction. Moreover, if the marking particles on the receiver member do not have a mirror-like surface, incident light is reflected by diffusion from the marking particle surface and is not admitted into the marking particle layers, making the colors on the receiver member appear dark and cloudy. Therefore, low melting point marking particles are used. They yield few cavities and a hard flat surface so as to give glossy and vivid colors in the reproduction.

Low melting point marking particles are subject to increased image offset to the heating roller. This can produce undesirable defects in the reproduction or subsequent reproductions. Although image offset can be reduced by application of fuser oil to the heating roller, the use of such oil introduces further complications into the fusing system, such as handling of the oil and making sure that the layer of oil on the roller is uniform for uniform heat application. Alternatively, a mechanical arrangement for reducing image offset, without the need for fuser oil, has been found. Such mechanical arrangement, as shown for example in U.S. Pat. No. 5,256,507 (issued Oct. 26, 1993, in the name of Aslam et al), provides an elongated web which is heated to melt the marking particles and then cooled to cool the particles and facilitate ready separation of the receiver member with the marking particle image fixed thereto from the elongated web. The nature of operation of the elongated web arrangement also serves to increase the glossiness of the fixed marking particle image. As a result, such arrangement is particularly useful for multi-color image fusing. However, there is still only a limited control available to select the degree of gloss to be provided for the image reproduction.

SUMMARY OF THE INVENTION

In view of the above, this invention is directed to a belt fusing accessory, for a reproduction apparatus, the belt fusing accessory providing selectable image gloss. The belt fusing accessory, as disclosed, includes a heated fuser roller and a pressure roller in nip relation with the fuser roller. A steering roller is located downstream of the nip between the fuser roller and the pressure roller. A fusing belt is entrained about the fuser roller and the steering roller. Heat to the fuser roller is controlled dependent upon the desired gloss condition for the colorant image on the receiver member.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
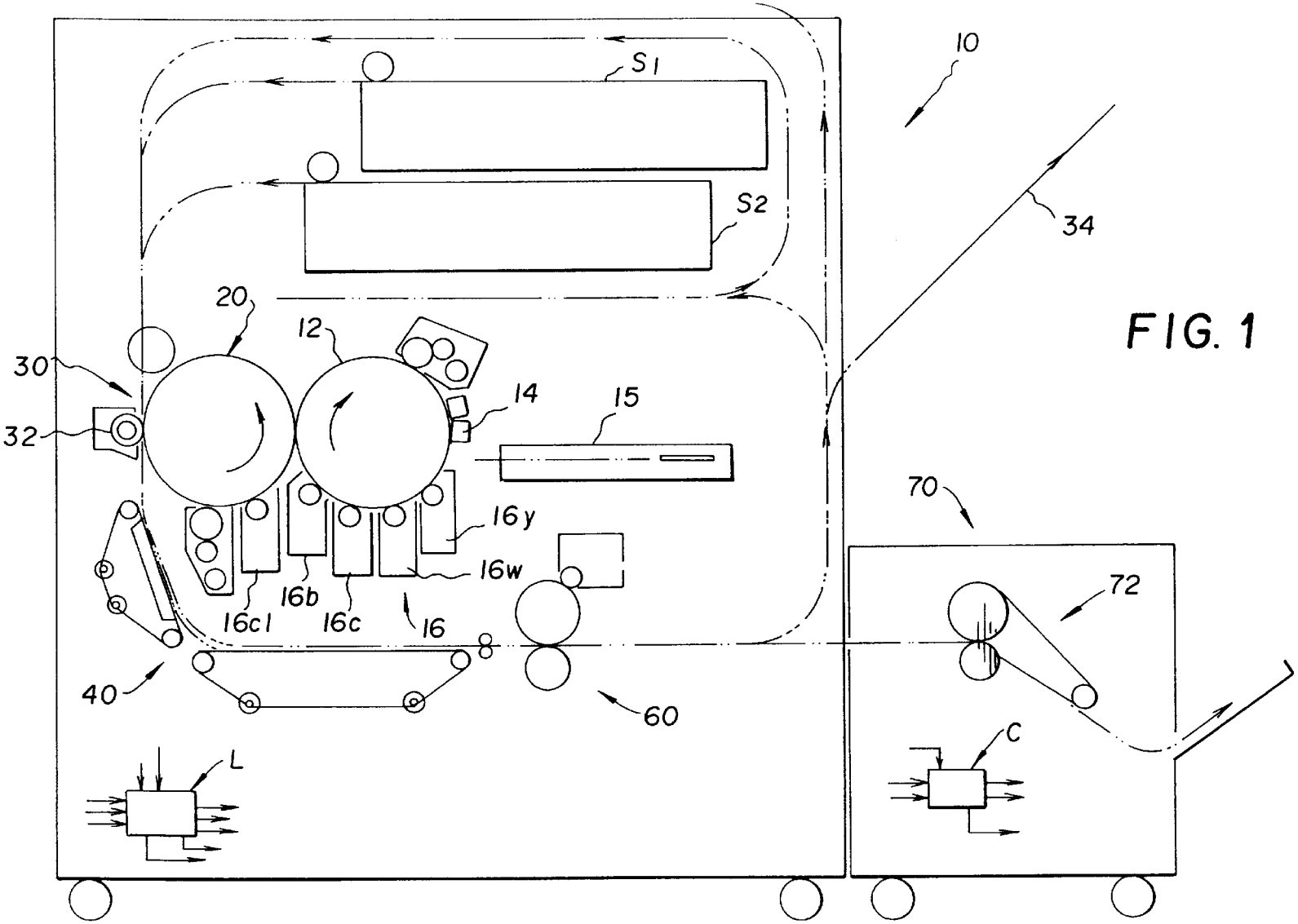
FIG. 1 is a front elevational view of an electrostatographic reproduction apparatus including a belt fusing accessory, according to this invention, for providing selectable image gloss.
Figure 2:
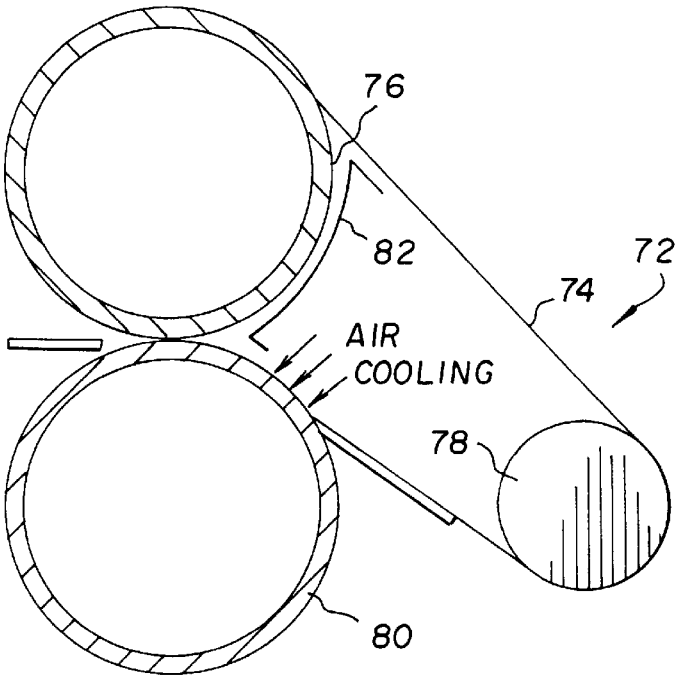
FIG. 2 is a front elevational view, on an enlarged scale, of the belt fusing accessory, according to this invention.

Referring now to the accompanying drawings, an electrostatographic reproduction apparatus, designated generally by the numeral 10, is shown in FIG. 1. While the reproduction apparatus 10 is shown as being of the electrophotographic type, it is readily appreciated that the belt fusing accessory according to this invention is suitable for use with other types of reproduction apparatus respectively employing various kinds of image colorants, such as ink jet printers or thermal printers.

The exemplary reproduction apparatus 10 includes a primary image forming dielectric image support member, for example, a drum 12 having a photoconductive surface, upon which a pigmented marking particle image, or series of different color marking particle images, is formed. In order to form images, when the photoconductive drum 12 is rotated in the direction of the arrow associated therewith, the photoconductive surface of drum is uniformly charged by any suitable charger 14; then the drum surface is exposed imagewise by, for example, a laser 15 or light emitting diode (LED) array, to create a corresponding latent electrostatic image. The latent electrostatic image is developed by a application of pigmented marking particles to the image bearing drum 12 by a development station 16. In the embodiment of the reproduction apparatus 10 as shown, there are five developing units, each unit having particular different color marking particles associated respectively therewith. Specifically, developing unit 16*y* contains yellow marking particles, developing unit 16*m* contains magenta marking particles, developing unit 16*c* contains cyan marking particles, and developing unit 16*b* contains black marking particles. Of course, other color marking particles (e.g. red, green, blue, etc.) may be used in the particular developing units depending upon the overall arrangement of the development station 16 and operational characteristics of the color development scheme for the reproduction apparatus 10. Additionally, a developing unit 16*cl* is provided, containing clear marking particles, which is utilized to aid in improving the quality and gloss of reproduced images, in the manner more fully described in the aforementioned copending U.S. Pat. Application Ser. No. 08/992,872, filed in the name of Muhammed Aslam et al., on even date herewith.

Each developing unit is separately activated for establishing independent operative developing relation with drum 12 to apply different color marking particles respectively to a series of images carried on drum 12 to create a series of different color marking particle images. The developed marking particle image is transferred (or multiple marking particle images are transferred one after another in registration) to the outer surface of a secondary or intermediate image transfer member, for example, an intermediate transfer drum 20. Thereafter, the single marking particle image, or a multicolor image comprising multiple marking particle images respectively formed on the surface of the intermediate image transfer member drum 20, is transferred in a single step to a receiver member.

In order to provide control signals for the reproduction apparatus 10, appropriate sensors (not shown) of any well known type, such as mechanical, electrical, or optical for example, are utilized in the reproduction apparatus. Such sensors are located along the receiver member travel path and are associated with the primary image forming member photoconductive drum 12, the intermediate image transfer member drum 20, and the various other image processing stations of the reproduction apparatus. As such, the sensors detect the location of a receiver member in its travel path, and the position of the primary image forming member photoconductive drum 12 in relation to the image forming processing stations, and respectively produce appropriate signals indicative thereof. Such signals are fed as input information to a logic and control unit L including a microprocessor, for example. Based on such signals and a suitable program for the microprocessor, the unit L produces signals to control the timing operation of the various electrographic process stations for carrying out the reproduction process. The production of a program for a number of commercially available microprocessors, which are suitable for use with the invention, is a conventional skill well understood in the art. The particular details of any such program would, of course, depend on the architecture of the designated microprocessor.

The receiver member is transported along a path (designated by the chain-link lines of FIG. 1) into a nip 30 between intermediate image transfer member drum 20 and a transfer backing member, for example a roller 32. The receiver member is delivered from a suitable receiver member supply (hopper $S_1$ or $S_2$) into nip 30 where it receives the marking particle image. The receiving member exits the nip 30, and is transported by transport mechanism 40 to a fuser assembly 60 where the marking particle image is tacked to the receiver member by application of heat and/or pressure. After tacking the image to the receiver member, the receiver member is selectively transported to return to the transfer nip 30 to have a second side (duplex) image transferred to such receiver member, to a remote output tray 34 for operator retrieval, or to an output accessory such as the belt fusing accessory, according to this invention, designated generally by the numeral 70.

According to this invention, the belt fusing accessory 70 associated with the reproduction apparatus 10 is a standalone unit which can be positioned (as shown in FIG. 1) to directly receive output from a reproduction apparatus. As such the belt fusing accessory 70 can be used as an off-line device or an integrated accessory for an electrographic reproduction apparatus, inkjet or thermal printers, or any such color hard copy printing machine utilizing an image colorant, where control of the gloss of the final image, or to matching of the image gloss of the final image to that of a particular receiver member is desired. The belt fusing accessory 70 is capable of producing high gloss (G20>90) and the image gloss is controlled by varying the fusing temperature, as discussed below. Of course, the belt fusing accessory 70 could alternatively be located remote from a reproduction apparatus, in which case reproduction copies would be delivered and fed manually (or by any well known feed mechanism) thereto.

The belt fusing accessory 70 includes an input transport for delivering image-bearing receiver members to a fusing assembly, designated generally by the numeral 72. The fusing assembly 72 comprises a fusing belt 74 entrained about a heated fusing roller 76 and a steering roller 78. The fusing belt 74 is, for example, a thin metallic or heat resistant plastic belt. Metallic belts can be electroformed nickel, stainless steel, aluminum, copper or other such metals, with the belt thickness being about 2 to 5 mils. Seemless plastic belts can be formed of materials such as polyimide, polypropylene, or the like, with the belt thickness similarly being about 2 to 5 mils. Usually these fusing belts are coated with thin hard coatings of release material such as silicone resins, fluoropolymers, or the like. The coatings are typically thin (1 to 10 microns), very smooth, and shiny. Such fusing belts could also be made with some textured surface to produce images of lower gloss or increased texture.

A pressure roller 80 is located in nip relation with the heated fusing roller 76. The nip established between the pressure roller 80 and the fusing roller 76 is selected to provide an area where the fusing belt 74 wraps about an extended portion of the pressure roller circumference (between approximately 10 and 30%) A heat shield 82 is provided adjacent to the fusing roller 76 to limit the amount of heat radiated to the area of the fusing belt 74 remote from the fusing roller. An flow of air is directed at the wrap area 80*a* to cool such area. The cooling action provides for a commensurate cooling of a receiver member, bearing a marking particle image, while such member is held between the fusing belt 74 and the pressure roller 80. The cooling of the receiver member serves to substantially prevent offset of the marking particle image to the pressure roller.

With the belt fusing accessory 70, according to this invention, used off-line, the marking particle image is at least partially fixed by a fusing device integral with the reproduction apparatus (e.g., fuser 60 of the reproduction apparatus 10), the belt fusing accessory being used to enhance or manipulate the image gloss. It is preferable that the integral fuser of the reproduction apparatus does not employ any release fluid. This is because it has been found that when the release fluid (e.g., silicone oil) is present on copies, a blemish type of artifact is created when the image is subsequently highly glossed. As will be readily appreciated, this belt fusing accessory can also be used to provide for controlled gloss of ink jet or thermal printer output. Moreover, the belt fusing accessory 70, can be used to provide a surface finish, controlled gloss, and protective overcoat to receiver media containing colorant-developed photographic pictures, graphic displays, and text. It could also be used with the output of other types of reproduction apparatus (such as thermal or silver halide printers) to control or manipulate their gloss and keeping properties in conjunction with clear toner overcoat application.

Figure 3:
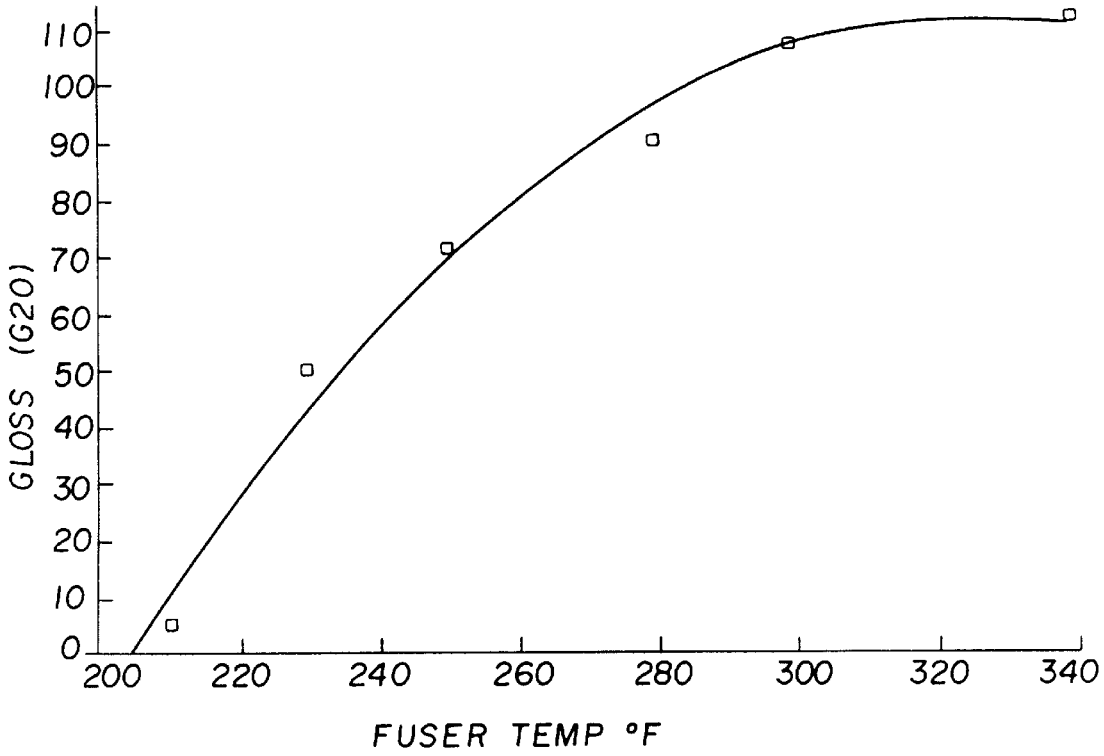
FIG. 3 is a graphic illustration showing the change in gloss level with varying fusing temperature.

The graph of FIG. 3 shows the glossing of a colorant image as a function of fusing temperature with the belt fusing accessory 70, according to this invention. As can be readily seen, a specific gloss (G20) between approximately 5 and 112 can be obtained by controlling the fusing temperature in the range of between 210° F. and 340° F. Similar plots could be generated with respect to the color hard copy image outputs from the other above mentioned reproduction apparatus or various types of receiver members. Such plots can be used as input of a control algorithm for a logic and control unit C of the belt fusing accessory 70 for setting a specific fusing temperature to get a desired level of gloss. The logic and control unit C includes a microprocessor, for example. Based on the control algorithm and a suitable program for the microprocessor, the unit C produces signals to control the operation of the belt fusing accessory 70. The production of a program for a number of commercially available microprocessors, which are suitable for use with the invention, is a conventional skill well understood in the art. The particular details of any such program would, of course, depend on the architecture of the designated microprocessor. Of course, if suitable, the logic and control unit L for the reproduction apparatus 10 could be used to control the operation of the belt fusing accessory.

Alternatively, fusing temperature set points could be programmed into the belt fusing accessory control algorithm according to a required gloss. The required gloss level, or the particular gloss characteristics of the receiver member type, could set up the fusing temperature from look up tables of the control algorithm for the logic and control unit C for the belt fusing accessory 70. Further, any well known gloss sensing device (not shown) could be installed on the receiver member feeder where the specific gloss of the receiver member is read. The corresponding fuser temperature may then be set automatically to match the image gloss to that of the receiver member.

The invention has been described in detail with particular reference to certain preferred embodiments thereof, but it will be understood that variations and modifications can be effected within the spirit and scope of the invention.

What is claimed is:

1. A belt fusing accessory for providing selectable image gloss to a colorant image formed on a receiver member by a reproduction apparatus, said belt fusing accessory comprising:

a heated fuser roller;

a pressure roller in nip relation with said fuser roller;

a steering roller located downstream of the nip between said fuser roller and said pressure roller;

a fusing belt entrained about said fuser roller and said steering roller;

a cooler for cooling said belt downstream of the nip between said fuser roller and said pressure roller, said cooler including a heat shield located in juxtaposition with said fuser roller to prevent undesirable cooling of said fuser roller; and a logic and control unit for selectively controlling heat to said fuser roller dependent upon the desired gloss condition for the colorant image on the receiver member.

2. The belt fusing accessory of claim 1 wherein said logic and control unit for selectively controlling heat correlates the temperature of said fuser roller with a specific image gloss.

3. The belt fusing accessory of claim 1 wherein said logic and control unit for selectively controlling heat correlates the temperature of said fusing roller to yield an image gloss corresponding to the gloss of a receiver member.

4. The belt fusing accessory of claim 1 wherein said fusing belt is formed of a smooth shiny metal.

5. The belt fusing accessory of claim 1 wherein said fusing belt is formed of a smooth shiny plastic.

6. The belt fusing accessory of claim 1 wherein said fusing belt is formed of a textured metal.

7. The belt fusing accessory of claim 1 wherein said fusing belt is formed of a textured plastic.

* * * * *